US007931517B2

(12) United States Patent
Yang et al.

(10) Patent No.: US 7,931,517 B2
(45) Date of Patent: Apr. 26, 2011

(54) LED-BASED WHITE-LIGHT LIGHTING MODULE FOR PREVENTING GLARE AND PROVIDING ADJUSTABLE COLOR TEMPERATURE

(75) Inventors: Joe Yang, Taichung (TW); Kai-Ming Yang, Taichung (TW)

(73) Assignee: Joe Yang, Taichung (TW)

( * ) Notice: Subject to any disclaimer, the term of this patent is extended or adjusted under 35 U.S.C. 154(b) by 143 days.

(21) Appl. No.: 12/380,188

(22) Filed: Feb. 25, 2009

(65) Prior Publication Data

US 2010/0216364 A1 Aug. 26, 2010

(51) Int. Cl.
*H01J 9/24* (2006.01)

(52) U.S. Cl. ..... 445/24

(58) Field of Classification Search ..... 445/24–25
See application file for complete search history.

(56) References Cited

U.S. PATENT DOCUMENTS

| | | | | |
|---|---|---|---|---|
| 6,765,237 | B1 | 7/2004 | Doxsee et al. | |
| 2005/0122294 | A1 * | 6/2005 | Ben-David et al. | 345/87 |
| 2008/0128679 | A1 * | 6/2008 | Tian et al. | 257/14 |
| 2008/0259632 | A1 * | 10/2008 | Chien | 362/565 |

* cited by examiner

*Primary Examiner* — Toan Ton
*Assistant Examiner* — Hana S Featherly
(74) *Attorney, Agent, or Firm* — Charles E. Baxley

(57) ABSTRACT

Disclosed is an illuminative module for enhancing the white balance while reducing thermal drift and color blocks. The illuminative module includes a substrate and light-emitting elements provided on the substrate to emitting light of the primary colors and a fourth color, respectively, so that the light of the primary colors is mixed with the light of the fourth color to provide white light.

15 Claims, 15 Drawing Sheets

Human eye's sensitivities to various wavelengths of light

| Wavelength (nm) | Human eye's sensitivity to light (nm) | Wavelength (nm) | Human eye's sensitivity to light (nm) | Wavelength (nm) | Human eye's sensitivity to light (nm) |
|---|---|---|---|---|---|
| 380 | 0.05 | 510 | 343.0 | 640 | 119.0 |
| 390 | 0.13 | 520 | 484.0 | 650 | 73.0 |
| 400 | 0.27 | 530 | 588.0 | 660 | 41.4 |
| 410 | 0.32 | 540 | 650.0 | 670 | 21.3 |
| 420 | 2.73 | 550 | 679.0 | 680 | 11.6 |
| 430 | 7.91 | 560 | 679.0 | 690 | 5.59 |
| 440 | 15.7 | 570 | 649.0 | 700 | 2.78 |
| 450 | 25.9 | 580 | 593.0 | 710 | 1.43 |
| 460 | 40.9 | 590 | 516.0 | 720 | 0.716 |
| 470 | 62.1 | 600 | 430.0 | 730 | 0.355 |
| 480 | 94.3 | 610 | 343.0 | 740 | 0.170 |
| 490 | 142.0 | 620 | 260.0 | 750 | 0.082 |
| 500 | 220.0 | 630 | 181.0 | 760 | 0.041 |

FIG. 2
PRIOR ART

LED-BASED WHITE-LIGHT LIGHTING MODULE FOR PREVENTING GLARE AND PROVIDING ADJUSTABLE COLOR TEMPERATURE

FIELD OF INVENTION

The present invention relates to a white light ("WL") lighting module based on light-emitting diodes ("LEDs") and, more particularly, to a method for making an LED-based WL lighting module that prevents glare and provides adjustable color temperature.

BACKGROUND OF INVENTION

III-V semiconductors are used to make photoelectric elements such as LEDs to emit light based on the electro-luminescence conversion effect. An LED is high in electroluminescence conversion efficiency but low in energy consumption. Hence, a lot of efforts have been made to develop LEDs for general lighting applications. There is a trend to use LEDs instead of current illuminative devices.

As disclosed in U.S. Pat. No. 6,765,237, a conventional LED includes a chip, a fluorescent layer provided on the chip and epoxy for packaging the chip and the yellow fluorescent layer. Based on the conversion effect, the chip emits blue light. The blue light turns the electrons of the fluorescent layer into an excited state from a ground state. In the excited state, the fluorescent layer emits yellow light. The blue light is mixed with the yellow light, thus providing WL. This is sometimes called "LED color-mixing technology."

This conventional LED is the mainstream product since its making and using are simple. However, the fluorescent layer is vulnerable to heat generated from the chip so that the wavelength of the light emitted from the LED changes, and the intensity of the illumination or luminance of the LED decays. This is sometimes called "fluorescent decay."

Currently, most LEDs emit WL based on the chemical color mixture. However, they suffer the above-discussed problems that have not been overcome. Therefore, such LEDs are not suitable for long-term applications.

Referring to FIG. 1, another conventional multi-chip LED lighting module includes a chip 1 for emitting red light ("RL"), another chip 2 for emitting green light ("GL") and another chip 3 for emitting blue light ("BL"). The wavelengths and intensities of the light of the primary colors must be carefully selected to provide WL. Even with careful selection, WL only exists in an area where the light beams of the primary colors overlap. Light turns to the primary colors away from the area. There are various color blocks.

The illuminative angles of the chips can be enlarged to mitigate the effect of color blocks. However, human eyes are more sensitive to GL with a wavelength of 555 nm than any other light. This is called spectrum sensitivity as shown in FIG. 2. Moreover, the conventional LED shown in FIG. 1 causes glare to human eyes.

Referring to FIG. 3, another conventional lighting module includes chips 4, 5 and 6 for respectively emitting BL, GL and RL, a package 7 for wrapping the chips 4, 5 and 6, a substrate 8 for supporting the chips 4, 5 and 6 and the package 7 and scattering particles 9 provided in the package 7. The scattering particles 9 scatters and mixes the RL, GL and BL respectively emitted from the chips 4, 5 and 6 into WL.

The conventional lighting module shown in FIG. 3 provides good mixture of the RL, GL and BL. It has not been made available on the market because it exhibits unacceptable color blocks. Moreover, the chips 4, 5 and 6 are provided in the single package 7 so that this conventional lighting module suffers overheating and does not last long.

Another conventional lighting module includes a WL LED, an RL LED, a GL LED and a BL LED. The WL LED is used as a major lighting module, and the RL LED, GL LED and BL LED color temperature-compensating units. If necessary, at least some of the color temperature-compensating units are activated to emit light to compensate the changes in the color temperature of white light emitted from the WL LED due to the thermal drift of the wavelength. The brightness, color temperature and color blocks of this conventional lighting module change tremendously after the WL LED decays. Moreover, it is difficult and uneconomic to precisely control currents provided to the LEDs.

Moreover, the wavelength of light emitted from an LED is determined by the structure of the epitaxy, materials used therein and the matching of lattices. The wavelength of the light emitted from the LED suffers thermal drift. That is, at the moment when the multi-chip LED lighting is actuated, the intensity of the red light is high so that the white light tends to be a warm color. As the multi-chip LED lighting goes on, the intensity of the blue light gets higher so that the white light tends to be a cold color. The thermal drift of the white light might be too big to achieve a good white balance. The intensity of illumination would be compromised accordingly.

Therefore, the present invention is intended to obviate or at least alleviate the problems encountered in prior art.

SUMMARY OF INVENTION

It is the primary objective of the present invention to provide a method for making a lighting module for preventing glare and providing adjustable color temperature.

To achieve the foregoing objective, the method includes the steps of providing a carrier, connecting red LED packages to the carrier, connecting green LED packages to the carrier and connecting blue LED packages to the carrier. Each of the red LED packages includes a red LED chip, a cover for covering the red LED chip and scattering particles scattered in the cover. Each of the green LED packages includes a green LED chip, a cover for covering the blue LED chip and scattering particles scattered in the cover. Each of the blue LED packages includes a blue LED chip, a cover for covering the blue LED chip and scattering particles scattered in the cover. The numbers and positions of the LED packages on the carrier are changeable to adjust the color temperature of light emitted from the lighting module and therefore prevent glare.

Other objectives, advantages and features of the present invention will become apparent from the following description referring to the attached drawings.

BRIEF DESCRIPTION OF DRAWINGS

The present invention will be described via detailed illustration of embodiments versus the prior art referring to the drawings.

FIG. 2 is a table of a human eye's sensitivities to various wavelengths of light.

DETAILED DESCRIPTION OF EMBODIMENTS

Figure 1:
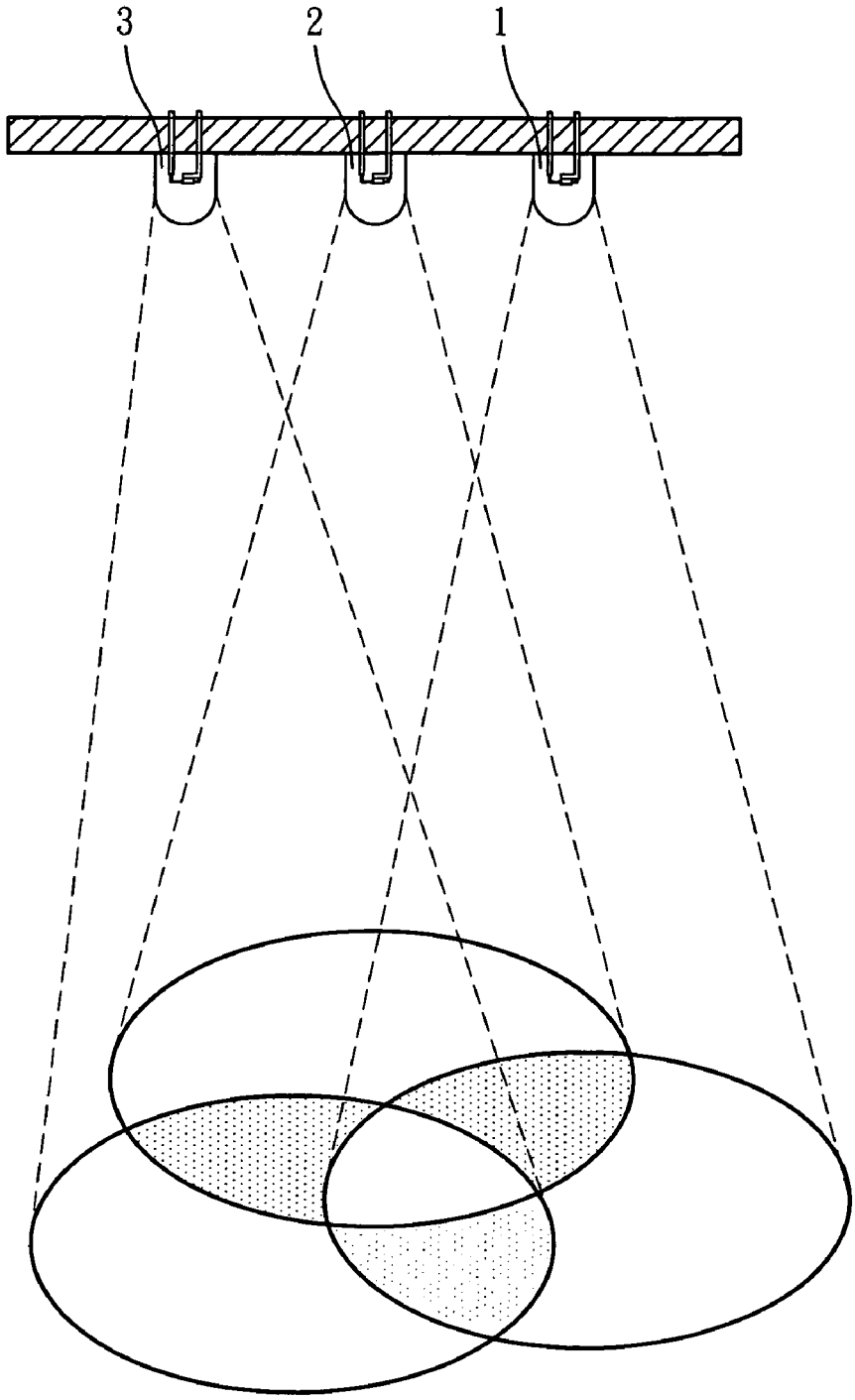
F I G . 1 PRIOR ART
FIG. 1 is a cross-sectional view of a conventional lighting module.
Figure 3:
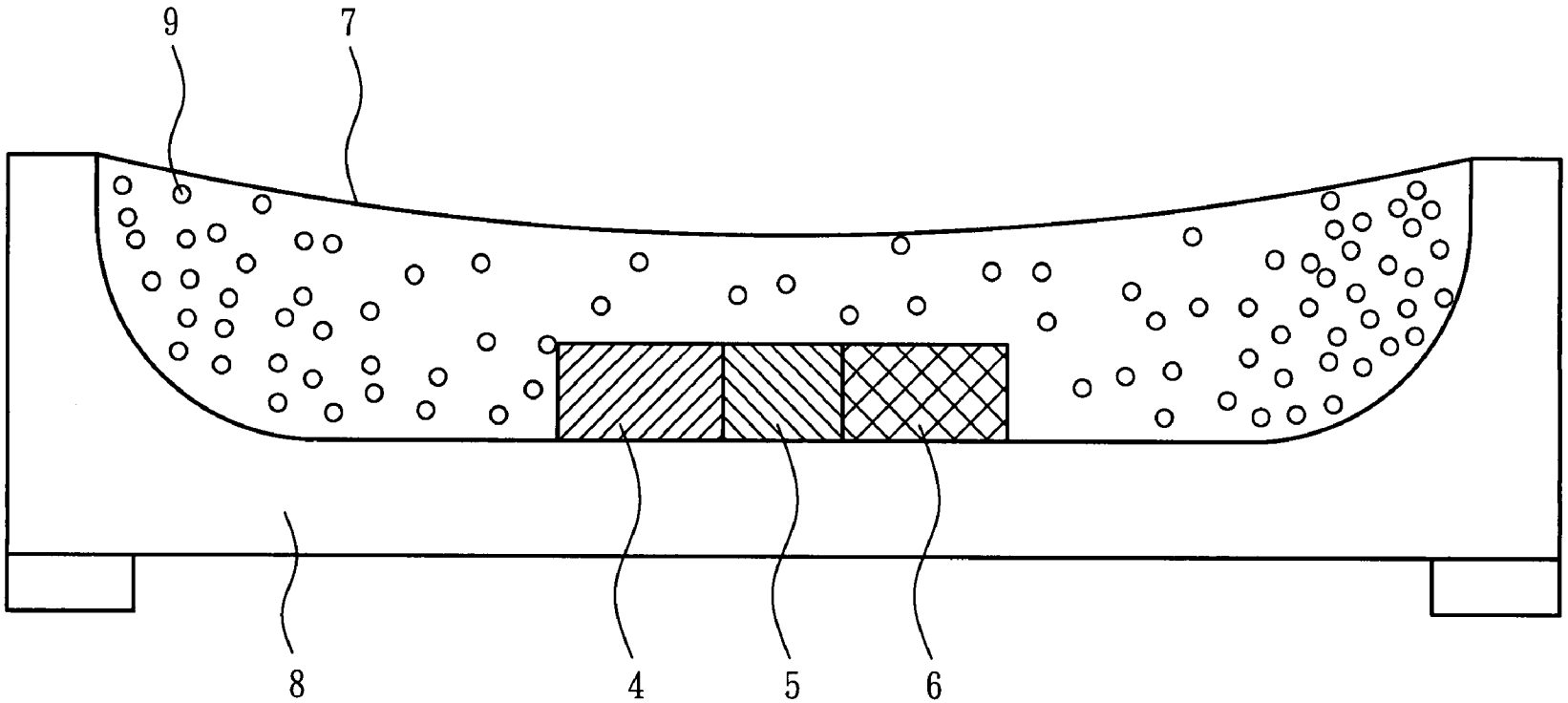
FIG. 3 PRIOR ART
FIG. 3 is a cross-sectional view of another conventional lighting module.
Figure 4:
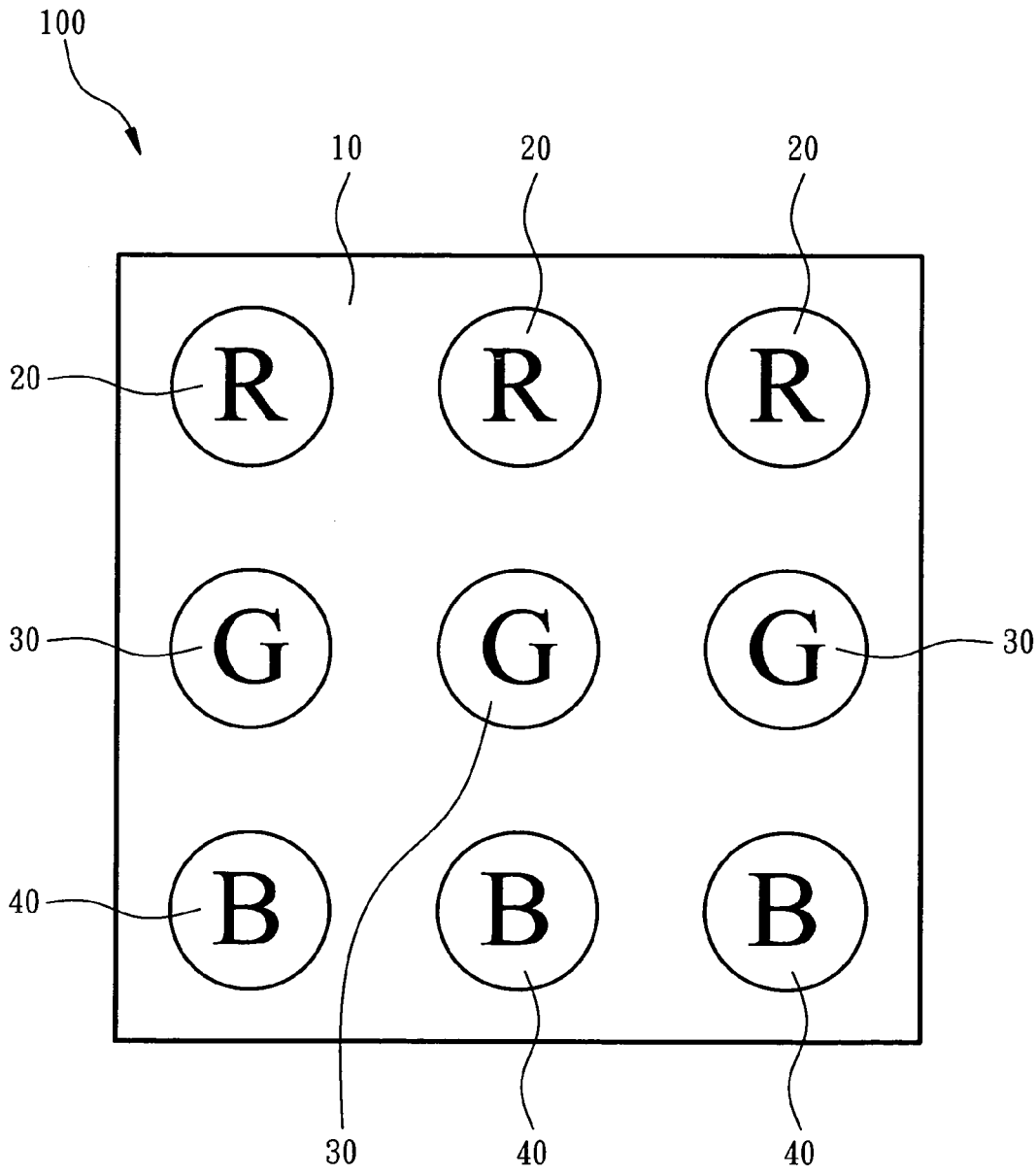
FIG. 4 is a top view of a lighting module according to a first embodiment of the present invention.

Referring to FIG. 4, shown is a lighting module 100 for preventing glare and providing adjustable color temperature according to a first embodiment of the present invention. The lighting module 100 includes a carrier 10, three RL LED packages 20, three GL LED packages 30 and three BL LED packages 40. The carrier 10 is preferably a printed circuit board ("PCB") provided with a layout of a circuit.

Figure 5:
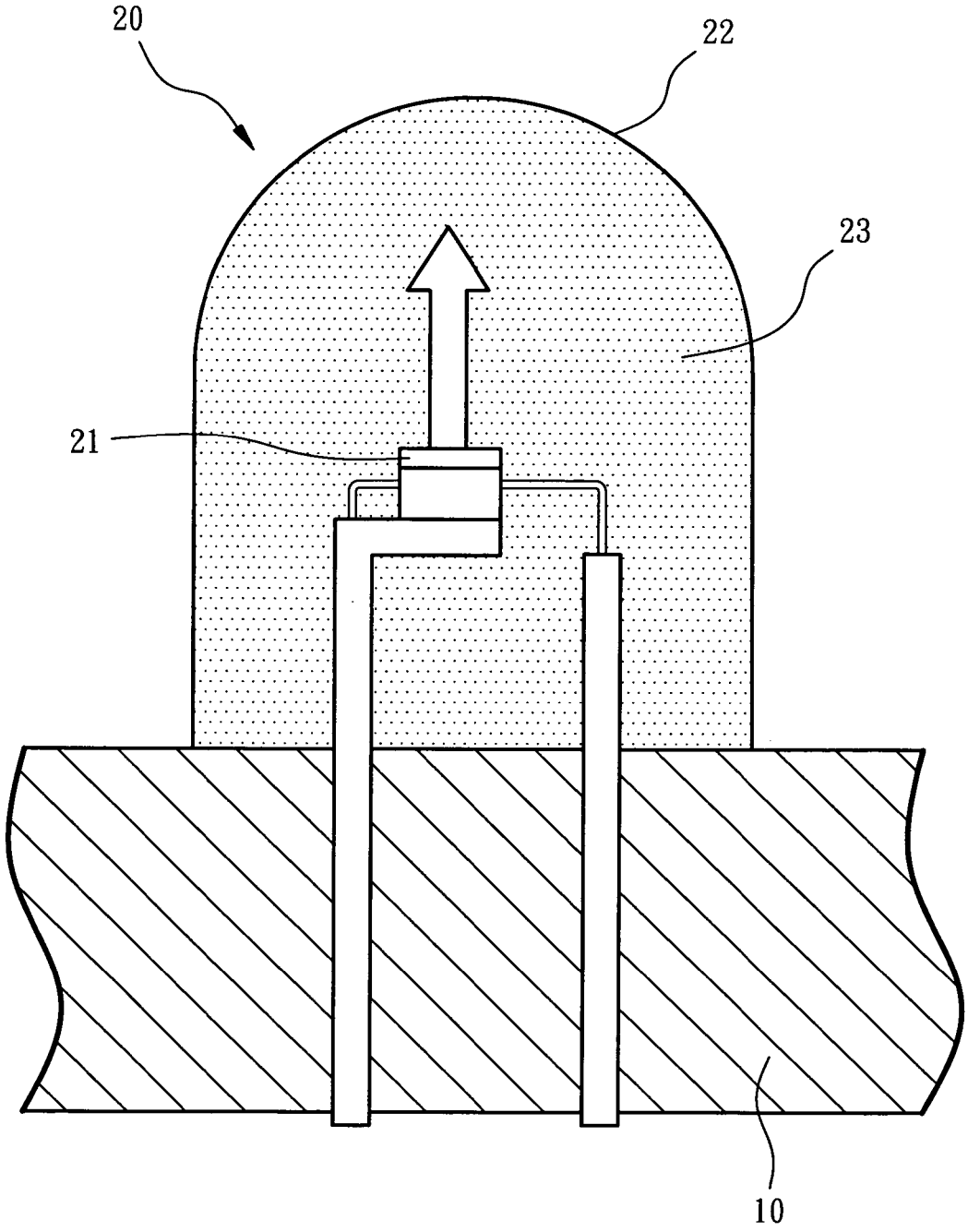
FIG. 5 is an enlarged cross-sectional view of an LED package used in the lighting module shown in FIG. 4.

Referring to FIG. 5, each of the RL LED packages 20 includes an RL LED chip 21, a cover 22 and scattering particles 23. The RL LED chip 21 is connected to the circuit of the carrier 10 so that the circuit of the carrier 10 can energize the RL LED chip 21 to emit RL. The cover 22 is made of a transparent material such as epoxy, silicone and glass. The cover 22 is provided over the RL LED chip 21. The scattering particles 23 are scattered in the cover 22. The RL LED packages 20 are located in predetermined positions on the carrier 10.

Each of the GL LED packages 30 includes a GL LED chip 31, a cover 32 and scattering particles 33. The GL LED chip 31 is connected to the circuit of the carrier 10 so that the circuit of the carrier 10 can energize the GL LED chip 31 to emit GL. The cover 32 is made of a transparent material such as epoxy, silicone and glass. The cover 32 is provided over the GL LED chip 31. The scattering particles 33 are scattered in the cover 32. The scattering particles 33 are made of a highly reflective or scattering material such as silver, resin and silicon. The GL LED packages 30 are located in predetermined positions on the carrier 10.

Each of the BL LED packages 40 includes a BL LED chip 41, a cover 42 and scattering particles 43. The BL LED chip 41 is connected to the circuit of the carrier 10 so that the circuit of the carrier 10 can energize the BL LED chip 41 to emit BL. The cover 42 is made of a transparent material such as epoxy, silicone and glass. The cover 42 is provided over the BL LED chip 41. The scattering particles 43 are scattered in the cover 42. The scattering particles 43 are made of a highly reflective or scattering material such as silver, resin and silicon. The BL LED packages 40 are located in predetermined positions on the carrier 10.

The scattering particles 23, 33 and 43 are made of at least one highly reflective or scattering material. For example, they can be made of silver, calcium carbonate ($CaCO_3$) and/or silicon dioxide ($SiO_2$) alone or in combination with resin.

Figure 6:
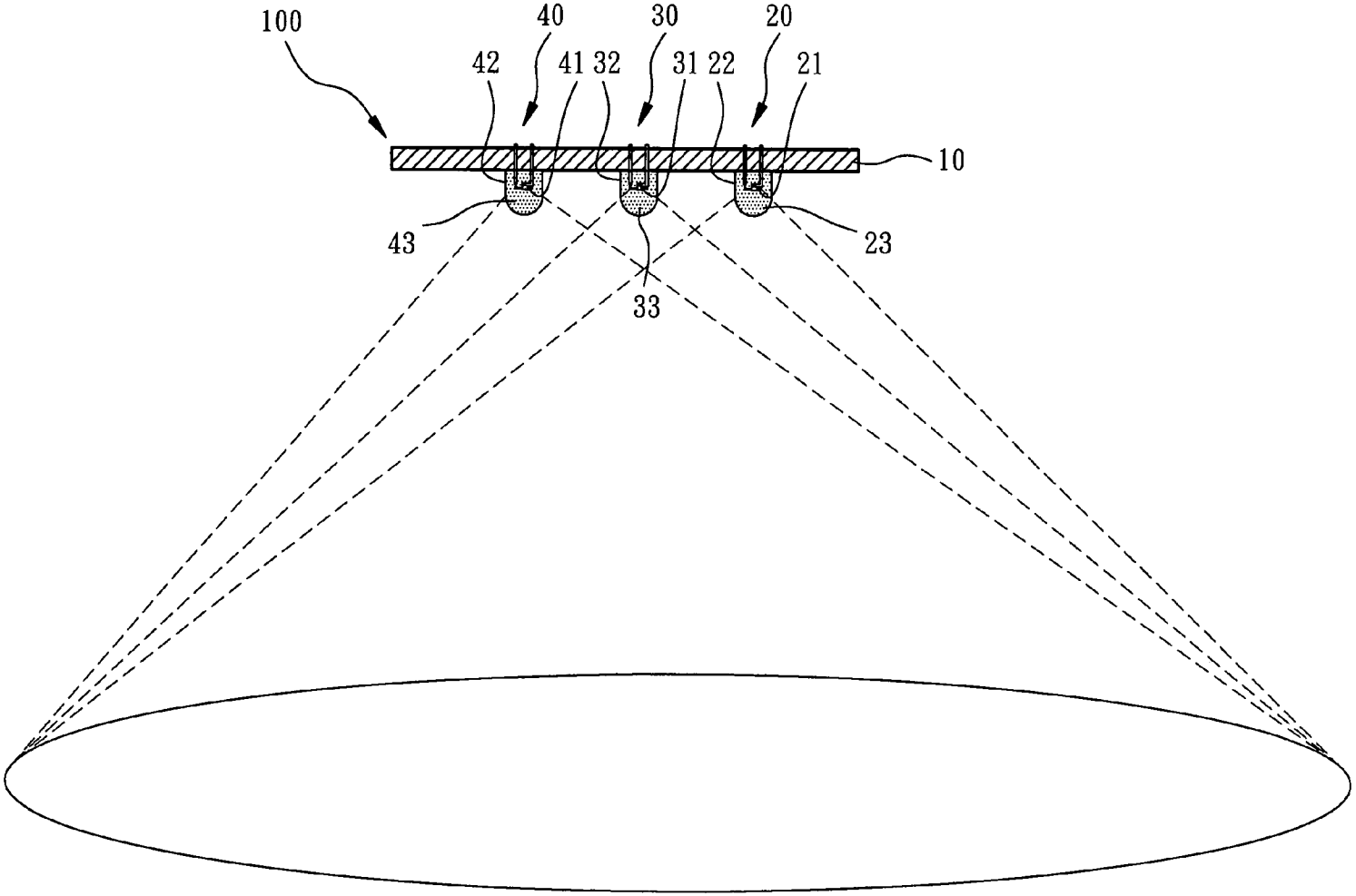
FIG. 6 is a cross-sectional view of the lighting module of FIG. 4.

Referring to FIG. 6, the RL LED packages 20 emit RL beams. The GL LED packages 30 emit GL beams. The BL LED packages 40 emit BL beams. The scattering particles 23, 33 and 43 cause the light beams to cast similar light spots that almost completely overlap one another, leaving small color blocks. Therefore, the RL, GL and BL are well mixed into WL. It should be noted that the numbers of the scattering particles 23, 33 and 43 within the LED packages 20, 30 and 40 are different from one another. The density of the scattering particles 23, 33 or 43 may change within the cover 22, 32 or 42.

Moreover, the LED chips 21, 31 and 41 are packaged independent of one another. Hence, the heat radiation of the lighting module 100 is better than that of a conventional lighting module with LED chips packaged in a common cover.

Furthermore, for including three RL LED packages 20, three GL LED packages 30 and three BL LED packages 40, their positions on the carrier 10 can be replaced with one another or changed to enable adjustment of the color temperature from cold to warm. For example, color temperature for indoor use may be different from color temperature for outdoor use. The color temperature of the light emitted from the lighting module 100 is adjustable without having to use a complicated mechanism to change a circuit or voltage provided thereto.

Figure 7:
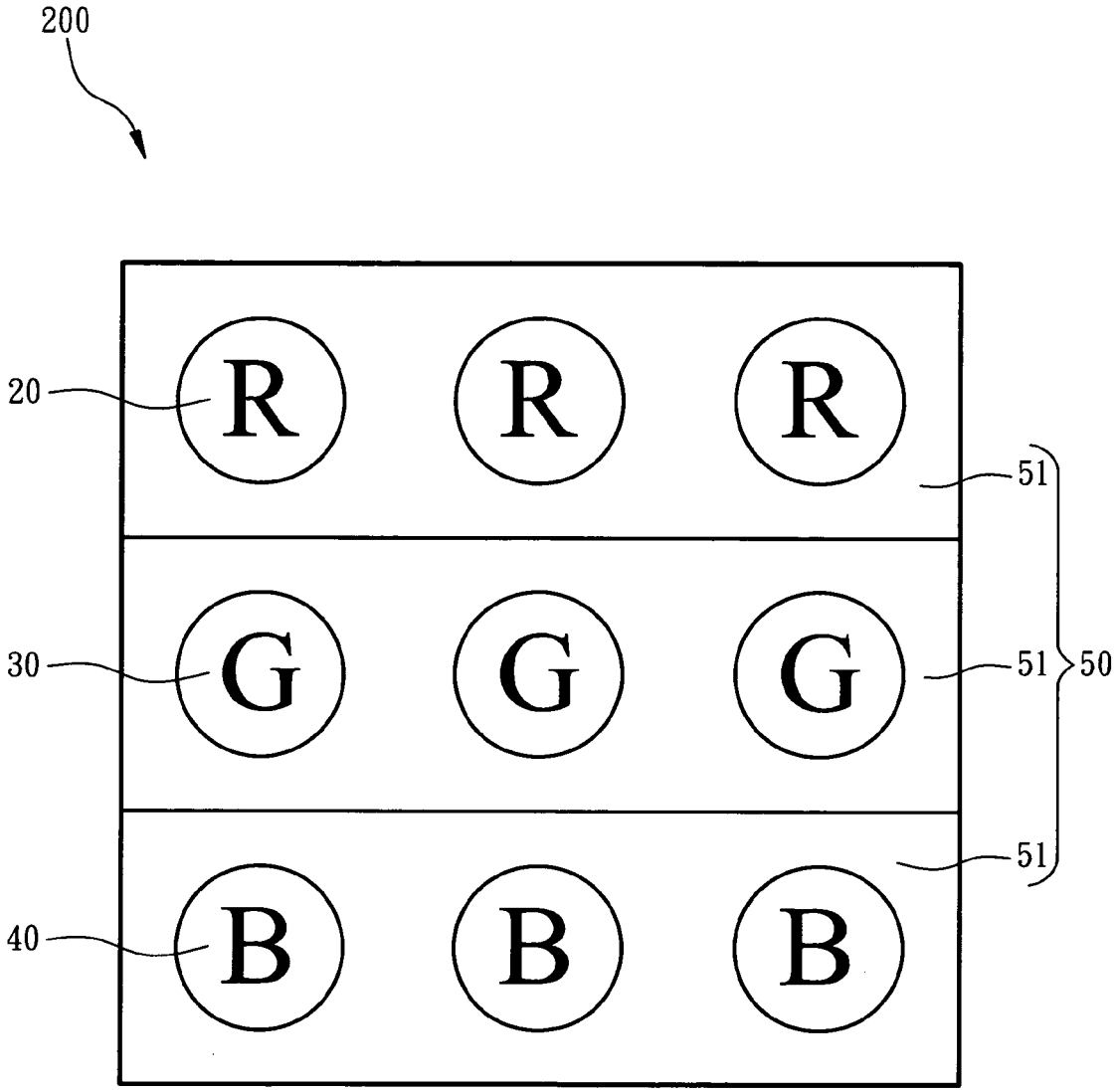
FIG. 7 is a top view of a lighting module according to a second embodiment of the present invention.

Referring to FIG. 7, there is shown a lighting module 200 according to a second embodiment of the present invention. The lighting module 200 is like the lighting module 100 except including a carrier 50 instead of the carrier 10. The carrier 50 includes three PCBs 51 connected to one another. One of the PCBs 51 carries the RL LED packages 20. Another one of the PCBs 51 carries the GL LED packages 30. The other one of the PCBs 51 carries the BL LED packages 40. The cost of the lighting module 200 is lower than that of the lighting module 100.

Figure 8:
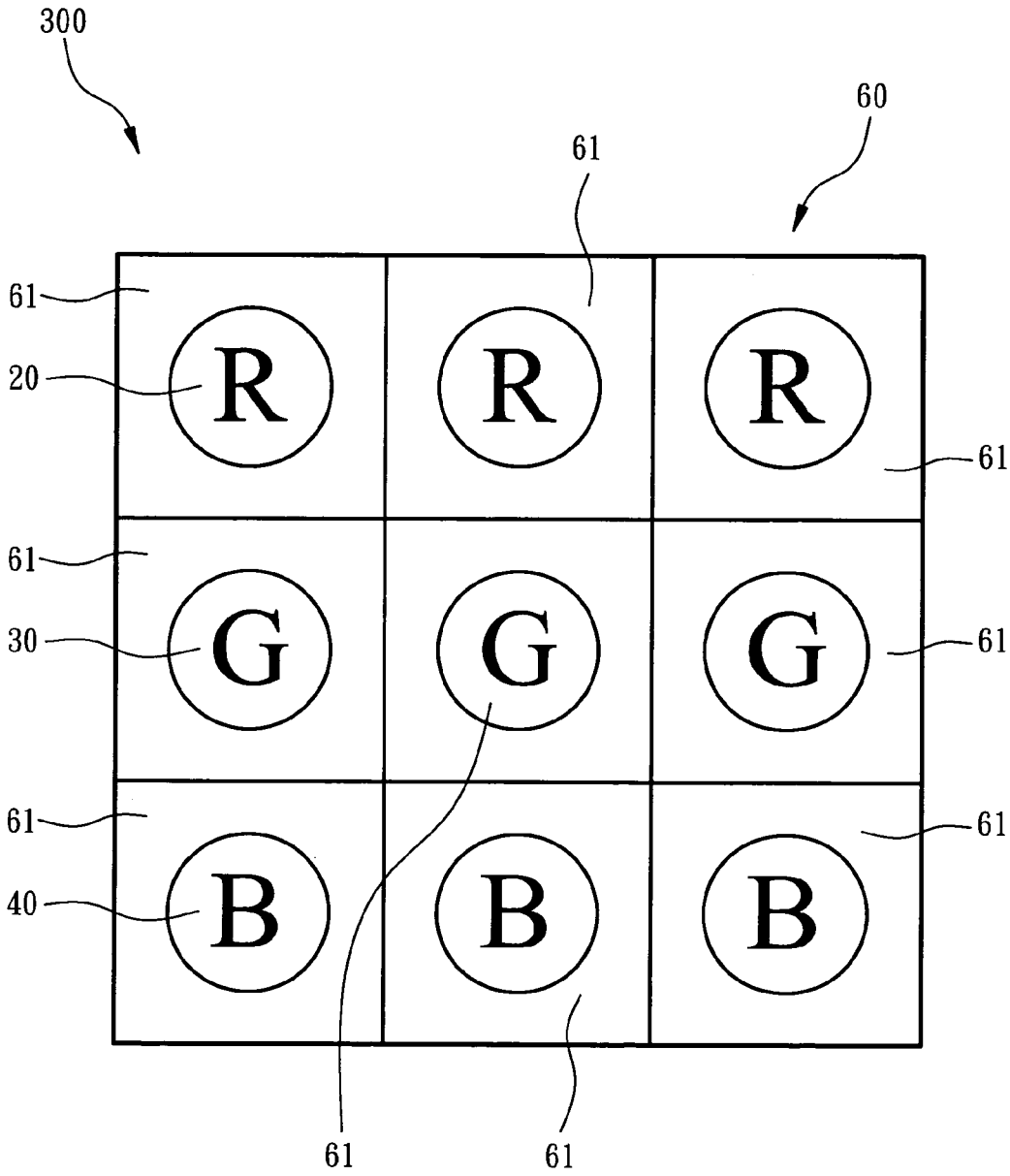
FIG. 8 is a top view of a lighting module according to a third embodiment of the present invention.

Referring to FIG. 8, there is shown a lighting module 300 according to a third embodiment of the present invention. The lighting module 300 is like the lighting module 100 except including a carrier 60 instead of the carrier 10. The carrier 60 includes nine PCBs 61 connected to one another. Each of the PCBs 61 carries a related one of the LED packages 20, 30 and 40. The cost of the lighting module 300 is lower than that of the lighting module 100.

Figure 9:
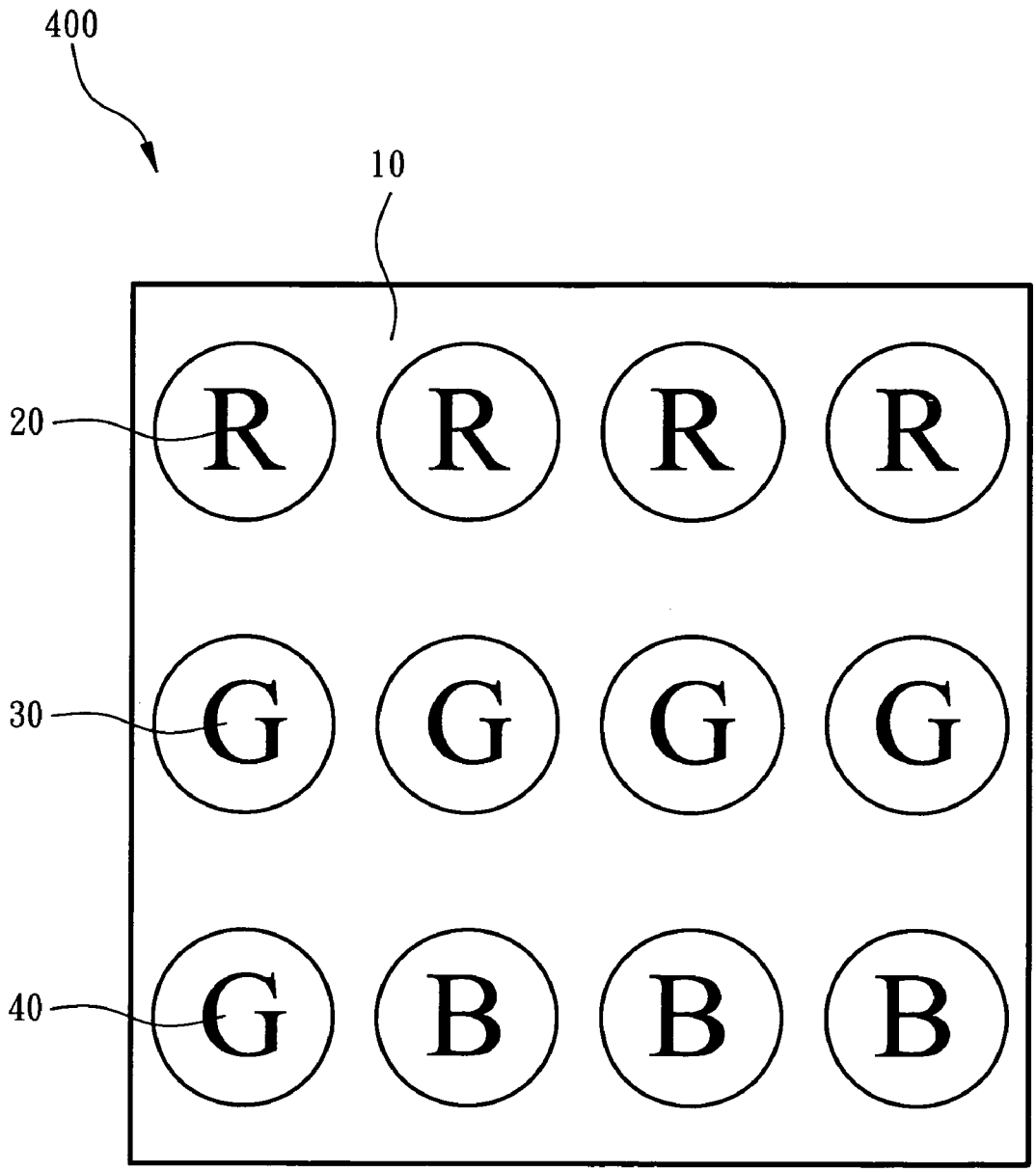
FIG. 9 is a top view of a lighting module according to a fourth embodiment of the present invention.

Referring to FIG. 9, there is shown a lighting module 400 according to a fourth embodiment of the present invention. The lighting module 400 is like the lighting module 100 except including 4 RL LED packages 20 and 5 GL LED packages 30. There are totally 12 LED packages arranged in a 4×3 array. The color temperature of light emitted from the lighting module 400 is different from light emitted from the lighting module 100.

Figure 10:
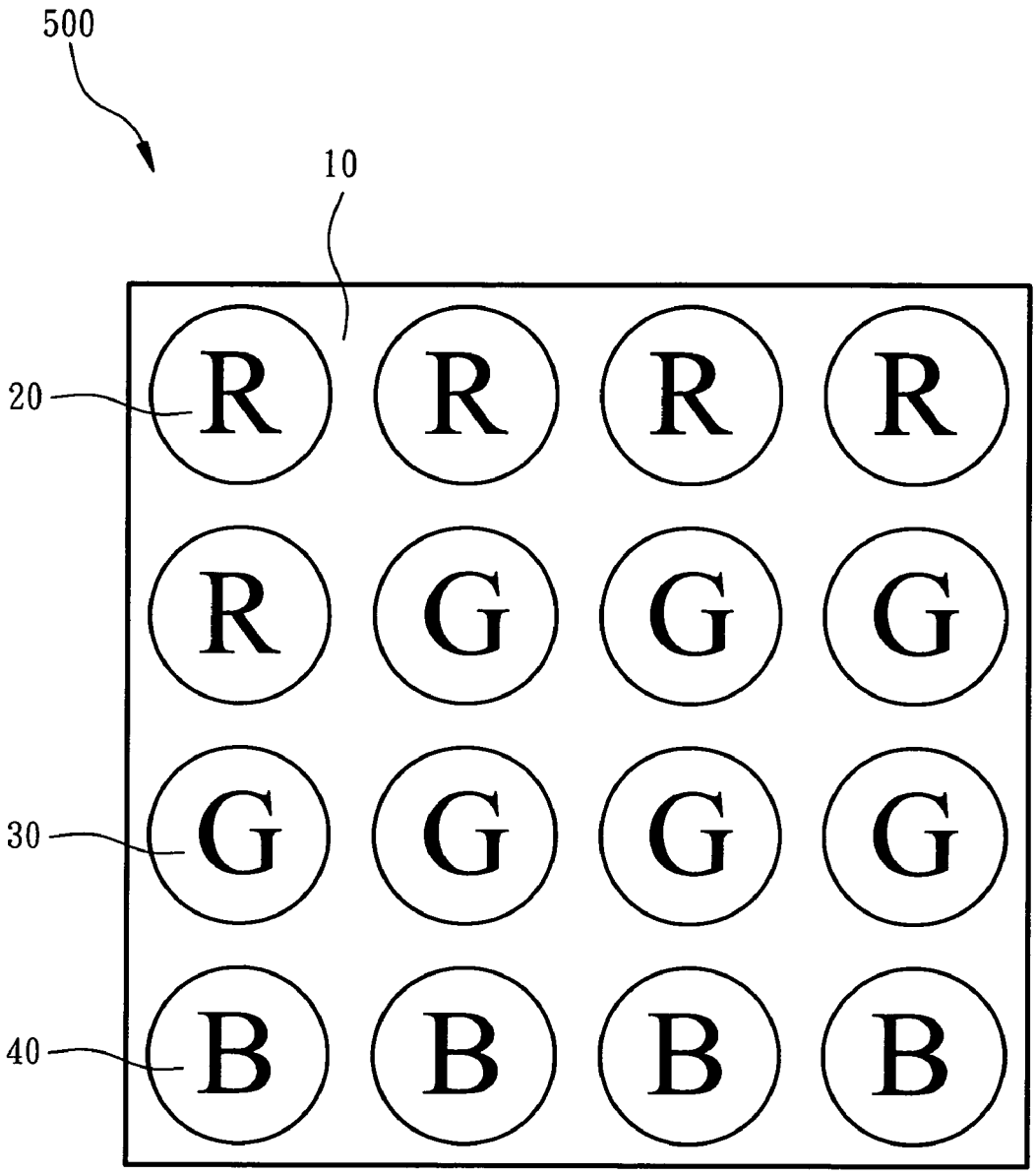
FIG. 10 is a top view of a lighting module according to a fifth embodiment of the present invention.

Referring to FIG. 10, there is shown a lighting module 500 according to a fifth embodiment of the present invention. The lighting module 500 is like the lighting module 100 except including 5 RL LED packages 20, 7 GL LED packages 30 and 4 BL LED packages 40. There are totally 16 LED packages arranged in a 4×4 array. The color temperature of light emitted from the lighting module 500 is different from light emitted from the lighting module 100.

Figure 11:
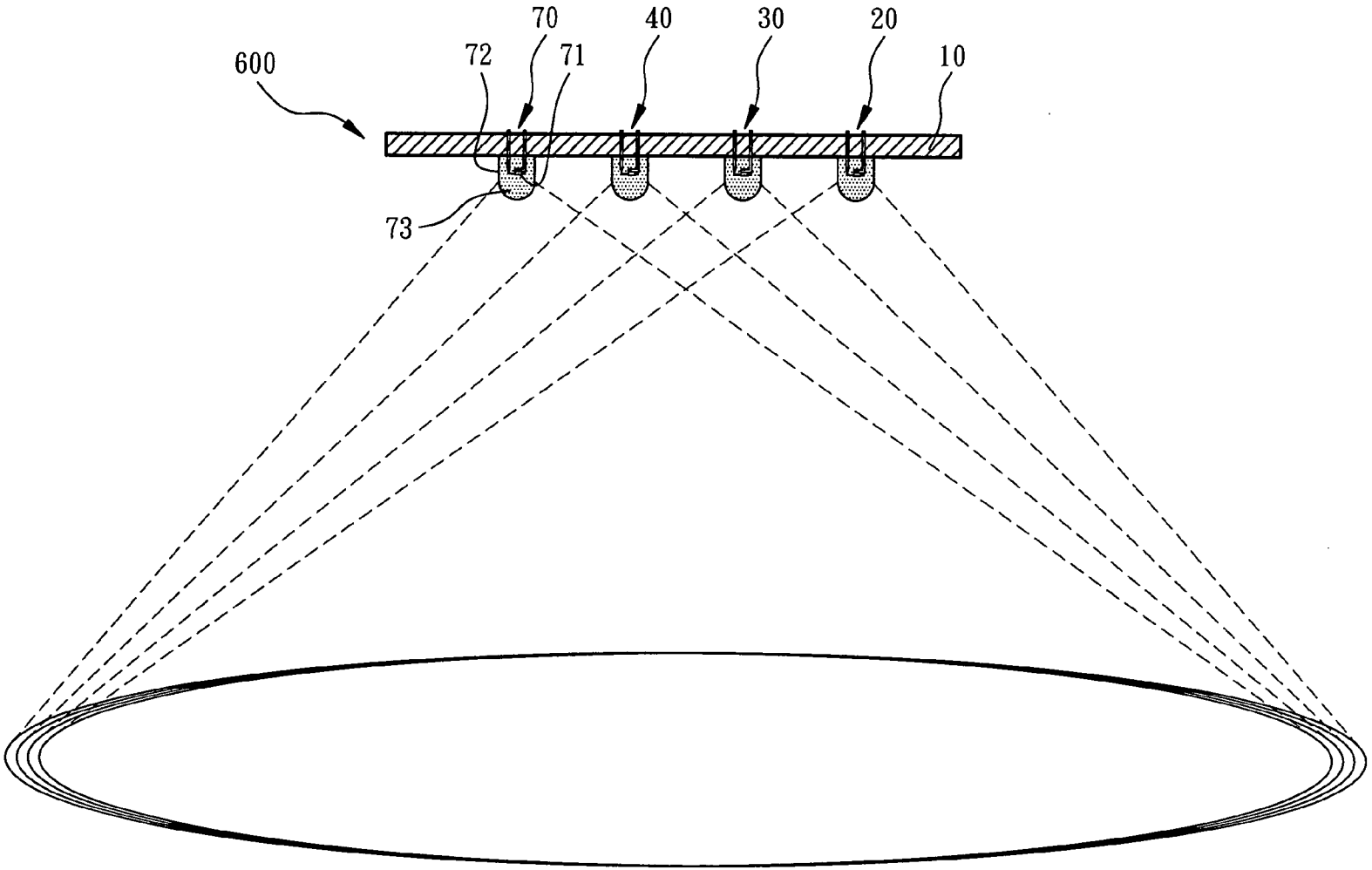
FIG. 11 is a cross-sectional view of a lighting module according to a sixth embodiment of the present invention.

Referring to FIG. 11, there is shown a lighting module 600 according to a six embodiment of the present invention. The lighting module 600 is like the lighting module 100 except including at least one LED package 70 including an LED chip 71, a cover 72 and scattering particles 73. The LED chip 71 is connected to the circuit of the carrier 10 so that the circuit of the carrier 10 can energize the LED chip 71 to emit light of a fourth color. The cover 72 is made of a transparent material such as epoxy, silicone and glass. The cover 72 is provided over the LED chip 71. The scattering particles 73 are scattered in the cover 72. The scattering particles 73 are made of a highly reflective or scattering material such as silver, resin and silicon.

Figure 12:
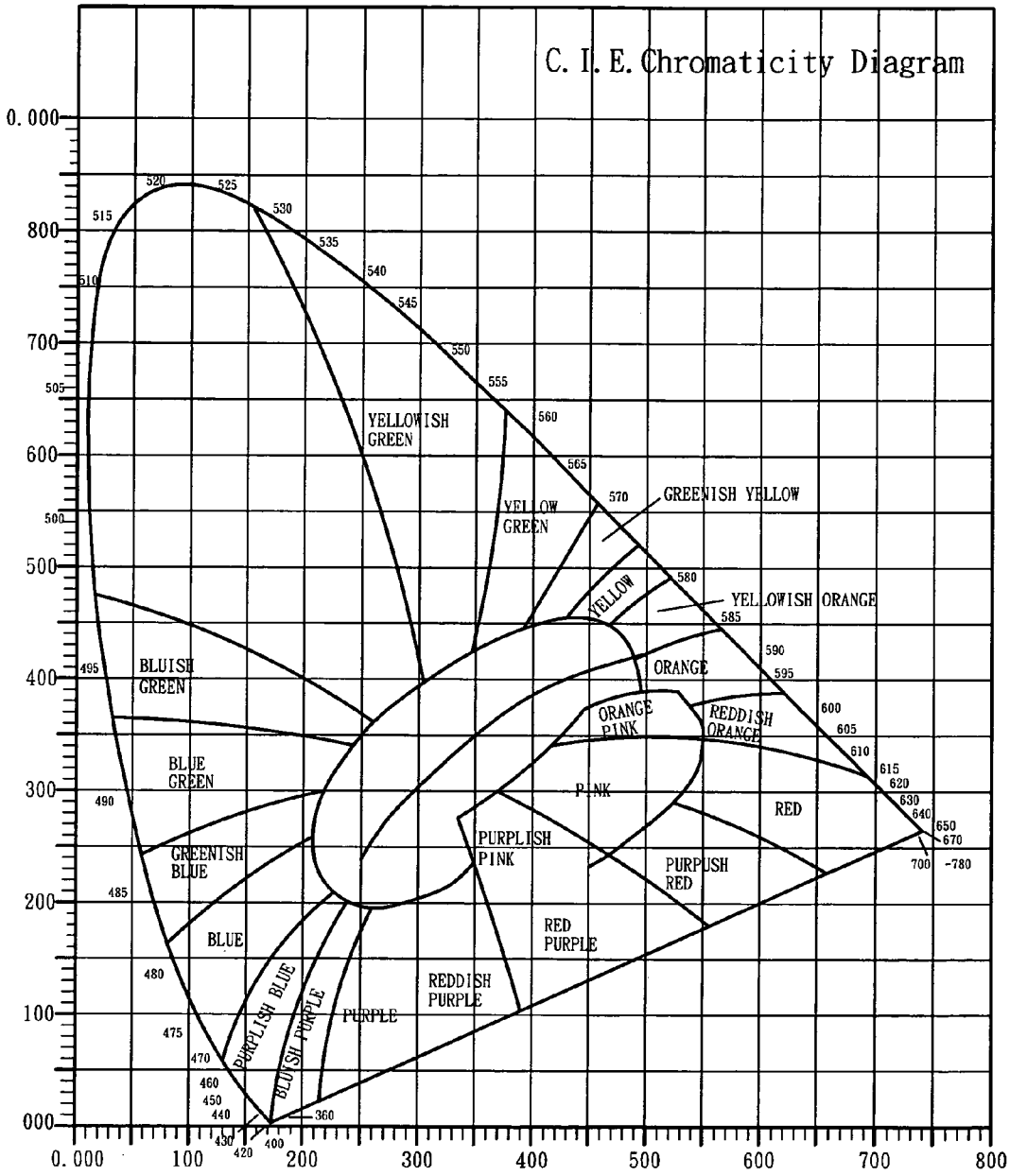
FIG. 12 is a C. I. E. chromaticity diagram.

Referring to FIG. 12, the wavelength of the fourth color is 560 to 610 nm or 470 to 500 nm. The fourth color is yellow if the wavelength is 560 to 610 nm or cyan if the wavelength is 470 to 500 nm. Preferably, the light of the fourth color is yellow light, which is a mixture of red light with green light. Yellow light can be mixed with blue light to provide white light. Yellow light can be mixed with greenish, reddish or bluish white light to provide white light with the color temperature falling in the central portion of the C. I. E. chromaticity diagram. Thermal shift of the wavelength in the spectrum is reduced, thus enhancing the white balance. The resultant white light is close to real white light.

Figure 13:
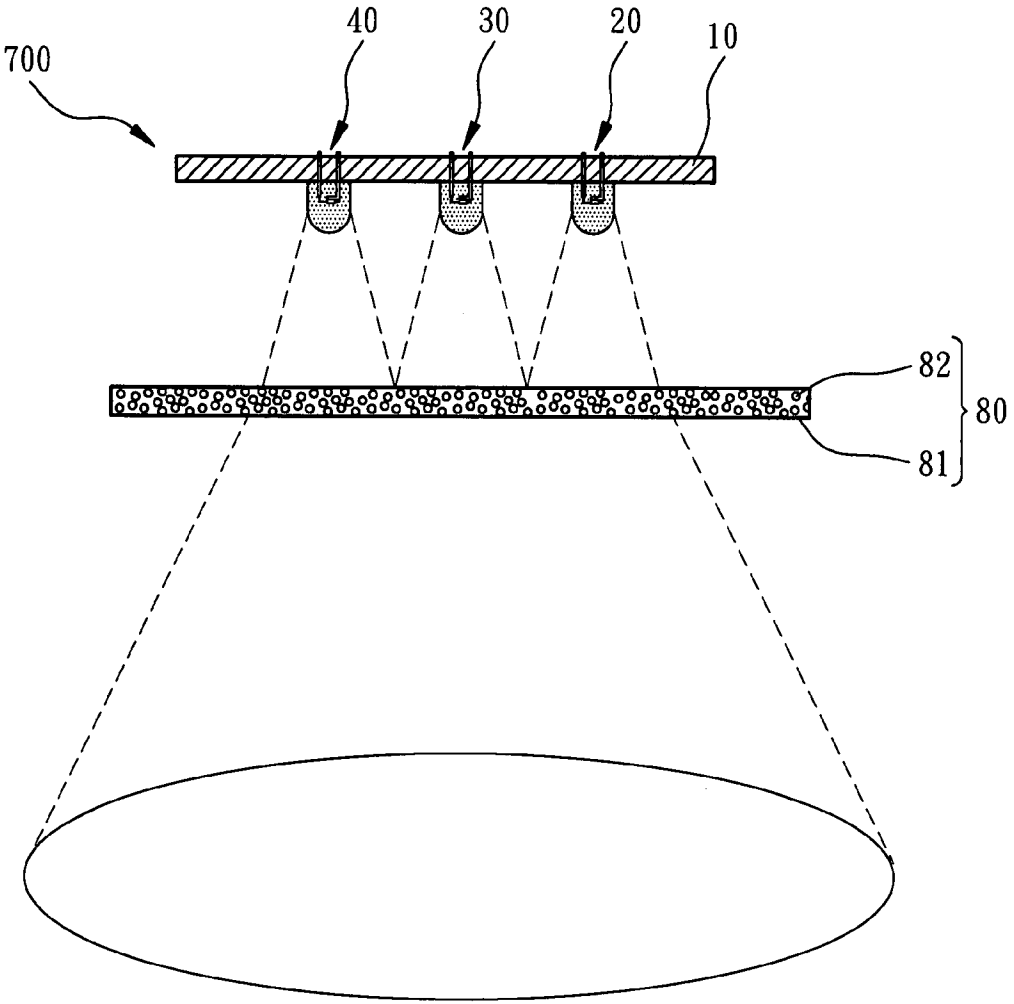
FIG. 13 is a cross-sectional view of a lighting module according to a seventh embodiment of the present invention.

Referring to FIG. 13, a lighting module 700 according to a seventh embodiment of the present invention is shown. The lighting module 700 is like the lighting module 100 except including a scattering panel 80 extending parallel to the carrier 10 so that the scattering panel 80 is at a same distance from the LED packages 20, 30 and 40. The scattering panel 80 includes a transparent panel 81 and scattering particles 82 evenly scattered in the transparent panel 81. The transparent panel 81 is made of epoxy, silicone, glass or any other proper material. The scattering particles 82 are made of a highly reflective or scattering material such as silver, resin and silicon. The scattering panel 80 causes the RL, GL and BL to be mixed with one another again. With this enhanced color mixture, there is no color block at all.

Figure 14:
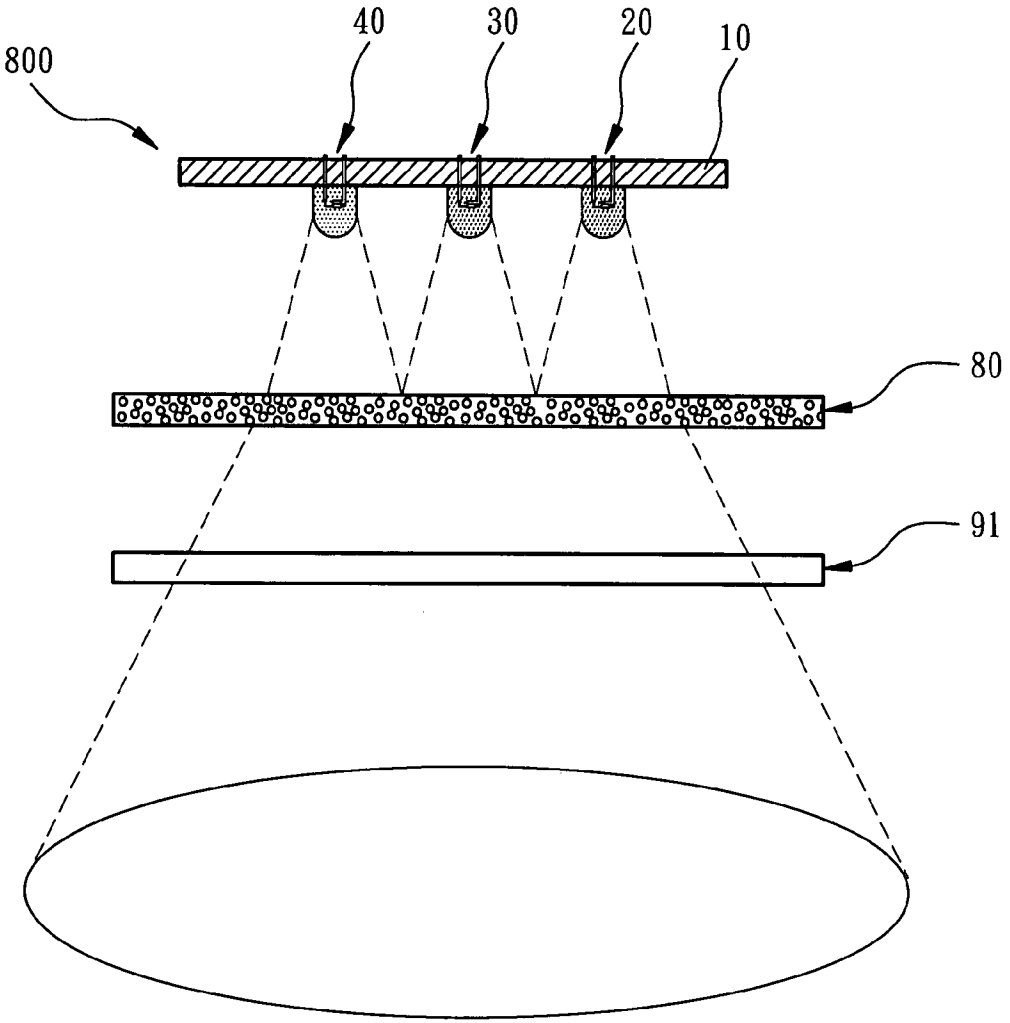
FIG. 14 is a cross-sectional view of a lighting module according to an eighth embodiment of the present invention.

Referring to FIG. 14, a lighting module 800 according to an eighth embodiment of the present invention is shown. The lighting module 800 is like the lighting module 700 except including an enhancing panel 91 extending parallel to the scattering panel 80. The enhancing panel 91 concentrates the WL so that the WL beam travels further than without the enhancing panel 91.

Figure 15:
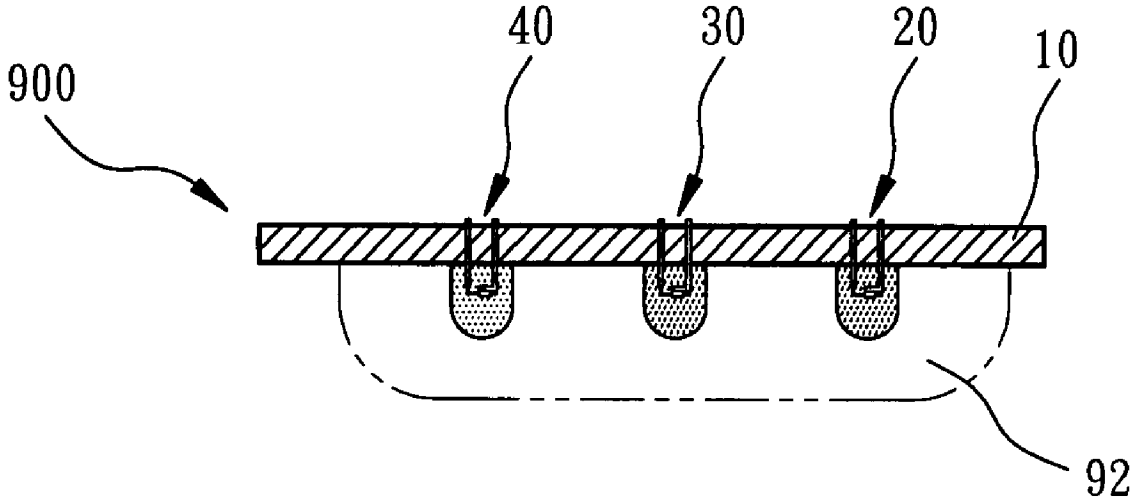
FIG. 15 is a cross-sectional view of a lighting module according to a ninth embodiment of the present invention.

Referring to FIG. 15, a lighting module 900 according to a ninth embodiment of the present invention is shown. The lighting module 900 is like the lighting module 100 except including a cover 92 for covering and protecting the LED packages 20, 30 and 40 from external objects. The cover 92 is made of a transparent material such as epoxy, silicone and glass.

In the above-mentioned embodiments, each of the LED chips 21, 31, 41 and 71 is packaged within a related one of the covers 22, 32, 42 and 72. The covers 22, 32, 42 and 72 can however be omitted and the LED chips 21, 31, 41 and 71 can be covered with a cover in which scattering particles are evenly scattered.

The present invention has been described through the detailed illustration of the embodiments. Those skilled in the art can derive variations from the embodiments without departing from the scope of the present invention. Therefore, the embodiments shall not limit the scope of the present invention defined in the claims.

The invention claimed is:

1. A method for making a lighting module for preventing glare and providing adjustable color temperature comprising the steps of:

providing a carrier;

connecting red light-emitting diode packages to the carrier, each of the red light-emitting diode packages comprising a red light-emitting diode chip, a cover for covering the red light-emitting diode chip and scattering particles scattered in the cover;

connecting green light-emitting diode packages to the carrier, each of the green light-emitting diode packages comprising a green light-emitting diode chip, a cover for covering the green light-emitting diode chip and scattering particles scattered in the cover; and connecting blue light-emitting diode packages to the carrier, each of the blue light-emitting diode packages comprising a blue light-emitting diode chip, a cover for covering the blue light-emitting diode chip and scattering particles scattered in the cover, wherein the numbers and positions of all of the light-emitting diode packages on the carrier are changeable to adjust the color temperature of light emitted from the lighting module and therefore prevent glare;

providing a cover for covering the red light-emitting diode packages, the green light-emitting diode packages and the blue light-emitting diode packages.

2. The method according to claim 1, wherein the carrier comprises at least one printed circuit board.

3. The method according to claim 1 further comprising the step of providing a scattering panel extending parallel to the carrier so that the scattering panel is at a same distance from the light-emitting diode packages, the scattering panel comprising a transparent panel and scattering particles scattered in the transparent panel.

4. The method according to claim 1 further comprising the step of providing an enhancing panel extending parallel to the carrier for concentrating the light so that the light travels further than without the enhancing panel.

5. The method according to claim 1 further comprising the step of providing at least one compensating light-emitting diode package connected to the carrier, wherein the compensating light-emitting diode package comprising a light-emitting diode chip for emitting light of a four color, a cover provided for covering all of the light-emitting diode chip and scattering particles scattered in the cover.

6. The method according to claim 5, wherein the compensating light-emitting diode package emits light with wavelength of 560 to 610 nm.

7. The method according to claim 5, wherein the compensating light-emitting diode package emits light with wavelength of 470 to 500 nm.

8. A method for making a lighting module for preventing glare and providing adjustable color temperature comprising the steps of:

providing a carrier;

connecting red light-emitting diode chips to the carrier;

connecting green light-emitting diode chips to the carrier;

connecting blue light-emitting diode chips to the carrier; and providing at least one cover for covering all of the light-emitting diode chips, scattering particles scattered in the at least one cover, wherein the numbers and positions of the light-emitting diode chips on the carrier are changeable to adjust the color temperature of light emitted from the lighting module and therefore prevent glare.

9. The method according to claim 8, wherein the carrier comprises at least one printed circuit board.

10. The method according to claim 8, wherein the step of providing at least one cover provides three covers respectively covering a related red light-emitting diode chips, green light-emitting diode chips and blue light-emitting diode chips.

11. The method according to claim 8, wherein the step of providing at least one cover provides a cover for covering all of the light-emitting diode chips.

12. A method for making a lighting module for preventing glare and providing adjustable color temperature comprising the steps of:

providing a carrier;

connecting red light-emitting diode chips to the carrier;

connecting green light-emitting diode chips to the carrier;

connecting blue light-emitting diode chips to the carrier;

connecting at least one compensating light-emitting diode chip to the carrier; and providing at least one cover for covering all of the light-emitting diode chips, scattering particles scattered in the at least one cover, wherein the numbers and positions of the light-emitting diode chips on the carrier are changeable to adjust the color temperature of light emitted from the lighting module and therefore prevent glare.

13. The method according to claim 12, wherein the carrier comprises at least one printed circuit board.

14. The method according to claim 12, wherein the step of providing at least one cover for respectively covering a related red light-emitting diode chips, green light-emitting diode chips, blue light-emitting diode chips and the at least one compensating light-emitting diode chip.

15. The method according to claim 12, wherein the step of providing at least one cover provides a cover for covering all of the light-emitting diode chips.

* * * * *